United States Patent [19]

Barchas

[11] Patent Number: 4,764,362

[45] Date of Patent: Aug. 16, 1988

[54] NAIL-CONDITIONING EMERY BOARDS AND PROCESS FOR MAKING THEM

[75] Inventor: Myron Barchas, Montclair, N.J.

[73] Assignee: The Cook Bates Company, Venice, Fla.

[21] Appl. No.: 921,960

[22] Filed: Oct. 22, 1986

[51] Int. Cl.[4] ..... A61K 7/04

[52] U.S. Cl. ..... 424/61; 132/76.4

[58] Field of Search ..... 424/61; 132/76.4; 51/297

[56] References Cited

U.S. PATENT DOCUMENTS

| | | |
|---|---|---|
| 2,969,330 | 1/1961 | Brynko . |
| 2,980,941 | 4/1961 | Miller . |
| 3,341,466 | 9/1967 | Brynko et al. . |
| 3,415,758 | 12/1968 | Powell et al. . |
| 3,472,675 | 10/1968 | Gordon et al. . |
| 3,516,846 | 6/1970 | Matson . |
| 3,516,941 | 6/1970 | Matson . |
| 3,516,943 | 6/1970 | Brynko et al. . |
| 3,598,123 | 8/1971 | Zaffaroni . |
| 3,617,334 | 11/1971 | Brockett et al. . |
| 3,619,842 | 11/1971 | Maierson et al. . |
| 3,640,629 | 2/1972 | Geiser et al. . |
| 3,686,701 | 8/1972 | Charle et al. . |
| 3,691,270 | 9/1972 | Charle et al. . |
| 3,978,204 | 8/1976 | Charle et al. . |
| 4,381,792 | 5/1983 | Busch, Jr. et al. . |

FOREIGN PATENT DOCUMENTS

| | | |
|---|---|---|
| 883333 | 6/1953 | Fed. Rep. of Germany . |

*Primary Examiner*—Stephen J. Lechert, Jr.
*Assistant Examiner*—Susan Wolffe
*Attorney, Agent, or Firm*—Darby & Darby

[57] ABSTRACT

A nail-and-cuticle conditioning emery board comprising a thin solid support strip having at least one abrasive surface adhesively attached to the support strip, and a thin film of a nail conditioning composition made up of a lubricant polyethylene glycol and a humectant polyethylene glycol, or absorbent emollient containing polymeric powder particles which are adhesively fixed to the abrasive surface. The use of the emery board results in conditioning of the fingernails and cuticles while filing them.

12 Claims, No Drawings

NAIL-CONDITIONING EMERY BOARDS AND PROCESS FOR MAKING THEM

FIELD OF THE INVENTION

This invention relates to novel emery boards that condition fingernails and cuticles while abrading them; and to a process for making such emery boards.

BACKGROUND OF THE INVENTION

Emery boards are old in the art. They usually comprise a support strip made of wood, cardboard, plastic or other such thin material and comprise at least one abrasive surface. The abrasive surface is usually a strip of sandpaper adhered onto the support and bearing abrasive particles, such as emery powder, flint, garnet, or another abrasive powder.

Emery boards are used to file fingernails in order to shape them and smooth them, and eliminate splits, snags or chipping and also to smooth the top of the nail surface.

Fingernails and cuticles are especially prone to chipping, splitting or snagging when they are dry. A number of conditioning agents and emollients are available on the market to condition fingernails and cuticles and reduce the drying tendency and therefore reduce splitting, chipping and snagging. These conditioning agents are normally liquids or semi-solids and are sold in containers. However, in many instances it is inconvenient to carry such containers. Liquids are difficult to transport; the containers are bulky and do not easily fit into a purse or toiletry case. Emery boards, on the other hand, are easy to transport.

SUMMARY OF THE INVENTION

It is an object of the present invention to develop a novel emery board that conditions fingernails and cuticles while filing them.

It is another object of this invention to provide a conditioning emery board that serves to reduce chipping, snagging and splitting of fingernails and to provide a shinier, healthier nail surface.

It is another object of this invention to develop a method for making such an emery board.

Yet another object of this invention is to provide a method for filing and conditioning nails in one step.

One aspect of the present invention is directed to a nail- and cuticle-conditioning emery board comprising:

a thin solid support strip having at least one abrasive surface comprising a substrate layer and abrasive particles adhesively fixed on said substrate; and a layer of a nail-conditioning composition selected from the group consisting of:

a layer of powder particles disposed on said abrasive surface, said powder particles comprising a polymeric powder containing entrapped therein an emollient suitable for conditioning nails and cuticles, said emollient being releaseable from said polymeric powder upon the application of pressure on said particles such as is normally applied on said emery board surface upon filing of fingernails; and a film comprising a lubricant, said film being sufficiently thin so as not to impart a greasy feeling to the touch on the emergy board and so as not to impede the abrasive action of said abrasive particles.

Another aspect of this invention is directed to methods for making the above emery board comprising the steps of:

providing a substrate selected from the group consisting of wood, cardboard and plastic sheets having first and second surfaces;

adhesively applying abrasive paper on at least one surface of said substrate;

forming on said abrasive surface a thin uniform film comprising a lubricant and a humectant selected from the group consisting of lubricant and humectant polyethylene glycols by applying a film of a solution comprising said lubricant and humectant on said surface and drying said surface, said film being sufficiently thin so as not to impart a greasy feeling to the touch on said emery board nor interfere with the abrasive action of said board; and cutting out emery boards from said surface in the desired shape.

An alternative embodiment of the present invention is directed to a method for making a nail- and cuticleconditioning emery board comprising the steps of:

providing a substrate selected from the group consisting of wood, cardboard and plastic sheets having first and second surfaces;

adhesively applying abrasive paper on at least one surface of said substrate;

depositing on said abrasive surface a layer of polymeric powder particles having an emollient entrapped therein;

fixing said particle layer on said abrasive surface by heating said surface to above the melting point of said polymer followed by discontinuing said heating whereby said powder adheres to said surface.

Yet another aspect of the present invention is directed to a method of filing and conditioning nails in one step using an emery board in accordance with the present invention.

DETAILED DESCRIPTION OF THE INVENTION

The invention is described below by reference to a particularly preferred embodiment. This description is intended to illustrate the present invention without limiting its scope.

The emery boards of the present invention are made as follows:

A support sheet is provided. The support is a thin sheet of wood or plastic or cardboard, preferably wood. A sheet of sandpaper is then adhered to both surfaces of the support. The sandpaper preferably consists of a paper substrate having a layer of abrasive particles adhesively attached to it. Flint, garnet and emery particles can be used as the abrasive.

After the abrasive paper is adhered on to the support and dried, the thus prepared abrasive board is ready for application of the nail-conditioning material. Typically, the size of such an abrasive board is many times the size of an individual emery board. Thus, many emery boards can be made from a single abrasive board.

The conditioning material may be applied by spraying, dipping, dusting or electrostatic transfer.

The conditioning material comprises one or more lubricants and/or an emollient either dissolved or suspended in a solvent or diluent or entrapped in an adsorbent polymeric powder base material.

According to one preferred embodiment, a lubricant composition is provided comprising one or more lubricant compounds. Preferred are combinations of two polyethylene glycols wherein one has lubricant properties and the other is slightly hygroscopic and acts as a humectant. Polyethylene glycols ranging from about 1000 to about 13750 in molecular weight are excellent waxy lubricants and enable the abrasive to cut smoothly and easily result in a smooth virtually unnoticeable abrasion pattern and a smooth abraded surface on the nail. Polyethylene glycols ranging from about 150 to about 600 molecular weight are somewhat hygroscopic and act as humectants which soften the cuticle and confer to the nail resistance to drying out.

Most preferred are combinations of two polyethylene glycols, such as Carbowax 400 and Carbowax 8000 (CARBOWAX Sentry Grade made by Union Carbide Corporation); and PEG8 and PEG150 (made by Dow Chemical Corp.). The two polyethylene glycols are preferably used in equal proportions.

The lubricant composition is dissolved in a liquid solvent, such as water or a volatile organic solvent, such that the solution contains from about 2% to about 20% of lubricant, with 10% being most preferred.

If the solvent employed is a volatile organic solvent, such as ethanol, or methylene chloride or other halocarbon or a specially formulated aerosol solvent such as one of Dow's AEROTHENE TM solvents, (which contain methylene chloride trichloroethane or another halocarbon), then the preferred mode of application is by spraying. Spraying should take place so that the board surface is completely covered with a uniform liquid film. Excess application which runs or drips should be avoided. The board can be left to dry by evaporation or the drying process may be accelerated by using hot air or radiant heat (e.g. an infrared heat source).

If an aqueous solvent is used, a bath of the dissolved lubricant composition can be prepared and the board can be dipped in it (thus ensuring the formation of a complete continuous film over the abrasive surface) and dried as described above.

The lubricant content of the solution should not be too high (e.g. over 20%) because this will result in a "greasy" emery board, which is unpleasant to the touch. In addition, "greasiness" can interfere with the abrasive action of the sandpaper.

The dried abrasive boards are then used to "stamp out" or cut out emery boards of the desired shape.

During filing, the lubricant from the emery board is applied on the fingernail being filed and serves to condition the nail and surrounding cuticle.

According to an alternative embodiment, a powdered conditioning formulation is applied on the abrasive board. This formulation comprises an emollient entrapped onto an adsorbent polymeric powder. A particularly preferred material is an acrylates copolymer (Cosmetic Toiletry and Fragrance Association adopted name—Cosmetic Ingredient Dictionary 3d Edition CTFA, 1982, p. 499 defined in the monograph section of the dictionary as a polymer of two or more monomers comprising acrylic acid, methacrylic acid or their simple esters) such as POLYTRAP® distributed by Wickhen Products Incorporated, Hughenot, N.Y. 12746.

This material has an emollient entrapped therein such as 2-ethylhexyl oxystearate. Any of POLYTRAP 131, 151, 171, 210, 229 and 801 can be used, but POLYTRAP E3251 is preferred. The loading of the emollient represents 30 to 70% of the powder weight. The preferred size range for the powder particles is from about 20 microns to about 800 microns.

The POLYTRAP powder is applied to the abrasive board either electrostatically or by dusting. A small amount of a flow-modifying agent such as CAB-O-SIL pyrogenic silica (Cabot Corp., Tuscola, Ill.) may be added to the POLYTRAP to enhance flow and reduce clumping (about 0.1–2% by weight) so as to produce an even and smooth deposition of powder.

The board is then preferably heated to a temperature just above the melting point of the abrasive adhesive, which causes the POLYTRAP powder to adhere to the abrasive board.

Upon application of the normal pressure exerted on the fingernail during filing, the emollient is released from the powder particles (as from a sponge) onto the nail and the cuticle and conditions and lubricates them, resulting in smooth nails and cuticles that resist drying out.

The emollient 2-ethylhexyl oxystearate is particularly preferred. It is a refatting agent of pronounced lubricant, softening and conditioning action.

Conditioning nails while filing them is particularly advantageous. The heat generated during abrasion of the nail aids in the adsorption of the conditioning agent by the nail and the cuticle. Moreover, the freshly abraded nail and cuticle surface is more adsorbent and takes up the conditioner more readily. Finally, the present invention eliminates the need for carrying a separate container with nail and/or cuticle conditioner, which may be cumbersome especially when space is limited as in a toiletry case used for travel or in a woman's purse.

What is claimed is:

1. A nail- and cuticle-conditioning emery board comprising:

a thin solid support strip having at least one abrasive surface adhesively attached onto said support, said abrasive surface comprising a substrate layer and abrasive particles adhesively fixed on said substrate and a nail-conditioning composition on said abrasive surface, said composition being selected from the group consisting of:

(a) a uniform film comprising a lubricant polyethylene glycol having a molecular weight between about 1000 and about 13,750 and a humectant polyethylene glycol having a molecular weight between about 150 and about 600, said film being sufficiently thin so as not to impart a greasy feeling to the touch and not to interfere with the abrasive action of said emery board; and (b) a layer of absorbent polymeric powder particles fixed on said abrasive surface having an emollient entrapped therein, said emollient being suitable for conditioning nails and being releasable from said polymeric powder upon the application of such pressure on said particles as is normally applied during filing fingernails.

2. The emery board of claim 1 wherein said polyethylene glycols are contained in about equal proportions in said layer.

3. The emery board of claim 2 wherein said humectant polyethylene glycol is PEG-8 and said lubricant polyethylene glycol is PEG-150.

4. The emery board of claim 1 wherein said polymeric powder containing said emollient is an acrylates copolymer.

5. The emery board of claim 4 wherein said emollient is 2-ethylhexyl oxystearate.

6. The emery board of claim 5 wherein said powder contains about 30–70% of said 2-ethylhexyl oxystearate based on the weight of said powder.

7. The emery board of claim 6 wherein said powder contains about 50% of said 2-ethylhexyl oxystearate based on the weight of said powder.

8. The emery board of claim 1 wherein said nail-conditioning composition is a film.

9. The emery board of claim 8 wherein said nail-conditioning composition is applied as a from about 2% to about 20% solution of said lubricant and humectant polyethylene glycol.

10. The emery board of claim 8 wherein said humectant polyethylene glycol is PEG-8 and said lubricant polyethylene glycol is PEG-150.

11. A method for conditioning fingernails by filing them with the emery board of claim 1.

12. A method for conditioning fingernails by filing them with the emery board of claim 4.

* * * * *